United States Patent [19]

Kato et al.

[11] 4,331,616

[45] May 25, 1982

[54] ADJUSTING SCREW OF A CARBURETOR

[75] Inventors: Yuzo Kato, Toyota; Mikitoshi Kako, Toukai; Kunio Kadowaki, Obu, all of Japan

[73] Assignees: Toyota Jidosha Kogyo Kabushiki Kaisha; Aisan Industry Co., Ltd., both of Aichi, Japan; a part interest to each

[21] Appl. No.: 217,123

[22] Filed: Dec. 17, 1980

[30] Foreign Application Priority Data

Aug. 12, 1980 [JP] Japan ..... 55-109878

[51] Int. Cl.[3] ..... F02M 7/22

[52] U.S. Cl. ..... 261/50 A; 137/382; 137/384; 261/DIG. 84

[58] Field of Search .... 261/50 A, DIG. 38, DIG. 84; 137/382, 384

[56] References Cited

U.S. PATENT DOCUMENTS

| | | | |
|---|---|---|---|
| 1,231,164 | 6/1917 | Jahns et al. | 137/384 |
| 2,274,587 | 2/1942 | Burton | 261/50 A |
| 2,457,570 | 12/1948 | Leibing | 261/50 A |
| 2,777,678 | 1/1957 | Udale | 261/50 A |
| 3,350,073 | 10/1967 | Hill | 261/50 A |
| 3,443,579 | 5/1969 | Doolittle | 137/382 |
| 3,484,084 | 12/1969 | Simpson et al. | 261/DIG. 38 |
| 3,695,589 | 10/1972 | Lamore | 261/50 A |
| 3,701,513 | 10/1972 | Carter | 261/50 A |
| 3,720,403 | 3/1973 | Windquist et al. | 261/50 A |
| 4,120,918 | 10/1978 | Codling | 261/DIG. 38 |
| 4,239,710 | 12/1980 | Sato | 261/DIG. 38 |

FOREIGN PATENT DOCUMENTS

| | | | |
|---|---|---|---|
| 430361 | 5/1925 | Fed. Rep. of Germany | 137/382 |
| 543094 | 5/1922 | France | 137/382 |
| 55-37566 | 3/1980 | Japan | 261/DIG. 38 |

*Primary Examiner*—Tim R. Miles

*Attorney, Agent, or Firm*—Stevens, Davis, Miller & Mosher

[57] ABSTRACT

An adjusting screw of a carburetor comprising a threaded portion, an enlarged head portion and a reduced diameter portion located therebetween. A thin hollow cylindrical wall is formed on a link lever of the carburetor. After the adjusting screw is screwed into the threaded hole of the hollow cylindrical wall, the reduced diameter portion of the adjusting screw is cut. Then, the top portion of the hollow cylindrical wall is bent inward for irremovably fixing the adjusting screw onto the link lever.

4 Claims, 8 Drawing Figures

ADJUSTING SCREW OF A CARBURETOR

DESCRIPTION OF THE INVENTION

The present invention relates to an adjusting screw of a carburetor and a method of irremovably fixing an adjusting screw onto a carburetor.

A carburetor is normally equipped with various adjusting screws for adjusting a carburetor when engines are assembled in factories. Such adjusting screws are most suitably adjusted in factories so as to obtain a good drivability and a good purifying efficiency of exhaust gas and, therefore, after adjustment, the adjusting screws are rigidly fixed onto a carburetor by means of lock nuts or an adhesive. However, since such lock nuts can be easily loosened by a general purpose tool, and the adhering portion can be relatively easily peeled off, users are able to easily operate the adjusting screw. Nevertheless, if users arbitrarily operate the adjusting screws which are most suitably adjusted, problems occur in that both the purifying efficiency of exhaust gas and the drivability will deteriorate.

An object of the present invention is to provide a carburetor equipped with adjusting screws which cannot be operated by users, but can be easily adjusted when engines are assembled in factories.

Another object of the present invention is to provide a method of irremovably fixing an adjusting screw onto a carburetor.

According to the present invention, there is provided a carburetor having a member which constructs a part of the carburetor and has an outer wall exposed to the exterior of the carburetor, said carburetor comprising: a hollow cylindrical wall formed on the outer wall of said member and having a threaded hole formed therein, said hollow cylindrical wall having a thin wall and a top face, and; an adjusting screw having an enlarged head portion which projects outward from the top face of said hollow cylindrical wall and having a threaded portion screwed into the threaded hole of said hollow cylindrical wall, said adjusting screw having a reduced diameter portion which is located between the top face of said hollow cylindrical wall and the enlarged head portion of said adjusting screw and has a diameter which is smaller than a minor diameter of the threaded portion of said adjusting screw.

In addition, according to the present invention, there is provided a method of fixing an adjusting screw onto a member which constructs a part of the carburetor and has an outer wall exposed to the exterior of the carburetor, said method comprising the steps of: forming on the outer wall of said member a thin hollow cylindrical wall having a threaded hole therein and a top portion which is remote from said member; forming an adjusting screw having a threaded portion, an enlarged head portion and a reduced diameter portion which is located between said threaded portion and said enlarged head portion and has a diameter smaller than a minor diameter of said thread portion; screwing the threaded portion of said adjusting screw into the threaded hole of said hollow cylindrical wall to a position wherein a portion of the reduced diameter portion of said adjusting screw enters into said threaded hole; cutting said reducing diameter portion and removing said enlarged head portion, and; bending inward the top portion of said hollow cylindrical wall.

The present invention may be more fully understood from the description of preferred embodiments of the invention set forth below, together with the accompanying drawings.

DESCRIPTION OF PREFERRED EMBODIMENTS

Figure 1:
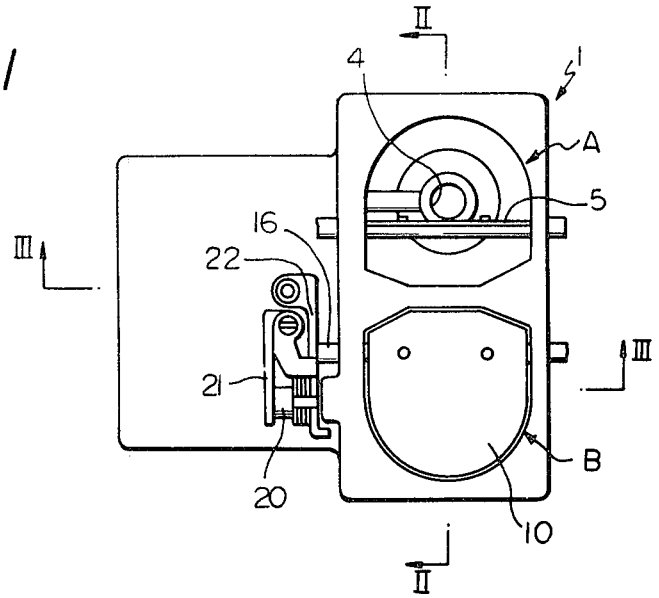
FIG. 1 is a plan view of an embodiment of a carburetor according to the present invention.
Figure 2:
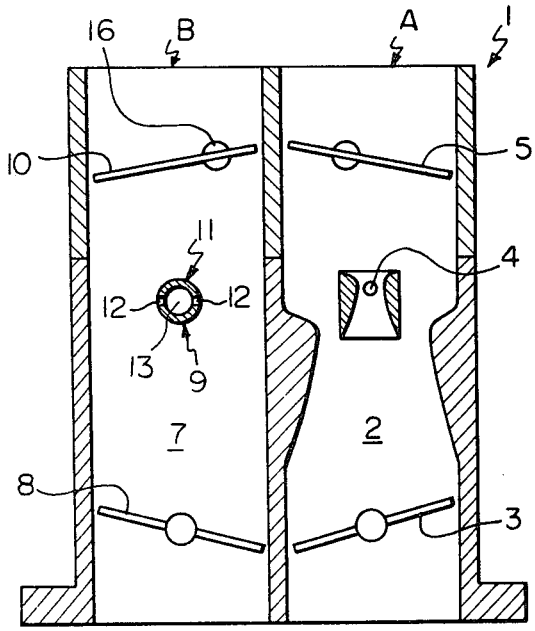
FIG. 2 is a cross-sectional side view taken along the line II—II in FIG. 1.
Figure 3:
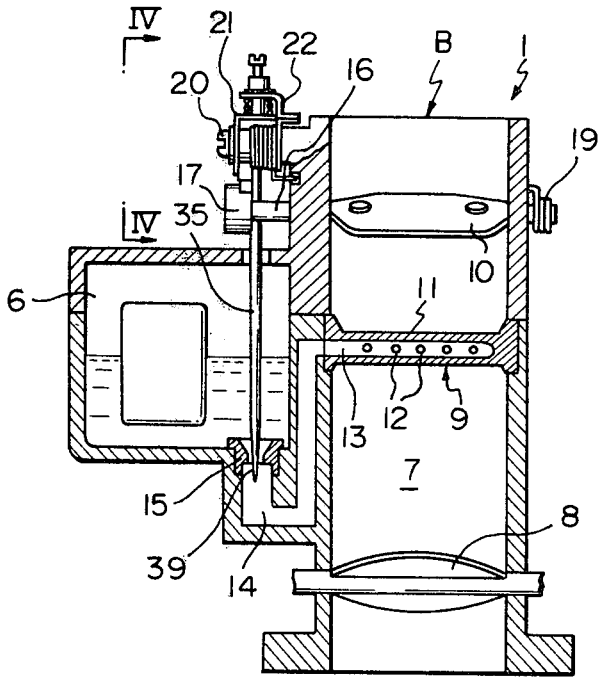
FIG. 3 is a cross-sectional side view taken along the line III—III in FIG. 1.

Referring to FIGS. 1 through 3, a carburetor, generally designated by reference numeral 1, comprises a primary carburetor A and a second carburetor B. The primary carburetor A has in its air horn 2 a primary throttle valve 3, a primary main nozzle 4 and a choke valve 5. The primary main nozzle 4 is connected to a float chamber 6 via a main fuel passage (not shown). The secondary carburetor B has in its air horn 7 a secondary throttle valve 8 and a secondary main nozzle 9 located upstream of the secondary throttle valve 8. In addition, an air valve 10 is arranged in the air horn 7 at a position located upstream of the secondary main nozzle 9. The secondary throttle valve 8 is connected to the primary throttle valve 3 via a link mechanism so that the secondary throttle valve 8 is opened when the opening degree of the primary throttle valve 3 becomes larger than a predetermined opening degree. As illustrated in FIGS. 2 and 3, the secondary main nozzle 9 is formed by a hollow tube 11 which extends along the diameter of the air horn 7 over the entire length thereof. A plurality of spaced nozzle holes 12, which are directed to a direction perpendicular to the axis of the air horn 7, is formed on the opposed side walls of the hollow tube 11. A fuel passage 13 is formed in the hollow tube 11 and connected to the float chamber 6 via a main fuel passage 14 and a metering jet 15.

Figure 4:
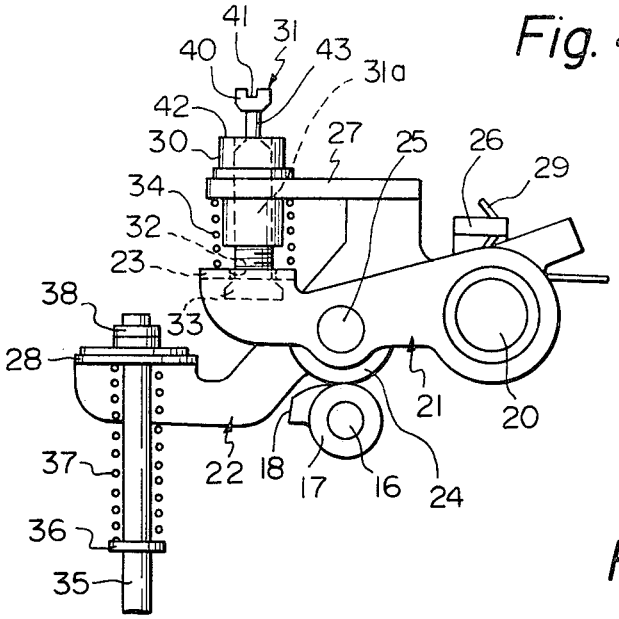
FIG. 4 is an enlarged side view taken along the line IV—IV in FIG. 3.

The air valve 10 is connected to a valve shaft 16 at a position which is offset from the center of the air valve 10, and a cam 17 is fixed onto the projecting outer end of the valve shaft 16, which projects from the housing of the carburetor 1 into the exterior thereof. As illustrated in FIG. 4, the cam 17 has a cam face 18 which is so formed that the distance between the cam face 18 and the axis of the valve shaft 16 is gradually increased towards the counter-clockwise direction. In addition, as illustrated in FIG. 3, a coil spring 19 is arranged between the housing of the carburetor 1 and the projecting end of the valve shaft 16, which is located opposite to the cam 17. The air valve 10 is always biased towards its closed position due to the spring force of the coil spring 19.

Figure 5:
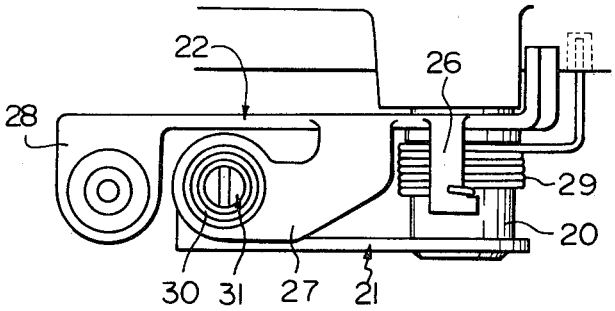
FIG. 5 is a plan view of FIG. 4.

Referring to FIGS. 1, 3, 4 and 5, a pivot pin 20 is fixed onto the housing of the carburetor 1, and a first lever 21 and a second lever 22 are pivotally mounted on the pivot pin 20. As illustrated in FIGS. 4 and 5, the first lever 21 has on its tip a flange 23 horizontally extending towards the housing of the carburetor 1, and a roller 24 is rotatably mounted on the first lever 21 via a supporting shaft 25 at a position between the flange 23 and the pivot pin 20. This roller 24 is always in contact with the cam face 18 of the cam 17. On the other hand, the second lever 22 has a single finger 26 and a pair of arms 28. One end of the coil spring 29 arranged around the pivot pin 20 is hooked on the finger 26, and the other end of the coil spring 29 is fixed onto the housing of the carburetor 1. The second lever 22 is biased in the counterclockwise direction in FIG. 4 due to the spring force of the coil spring 29 and, thus, the roller 24 is always urged onto the cam face 18. A hollow cylindrical portion 30, having a thin wall, is formed in one piece on the arm 27 of the second lever 22. The hollow cylindrical portion 30 has an internal threaded hole formed therein, and an adjusting screw 31 is screwed into the internal threaded hole. As illustrated by the broken line in FIG. 4, the lower end of the adjusting screw 31 passes through a hole 32 formed in the flange 23 of the first lever 21 and extends downwardly from the flange 23. The lower end of the adjusting screw 31 has an enlarged bottom portion 33 having a diameter which is larger than that of the hole 32. A compression spring 34 is inserted between the flange 23 of the first lever 21 and the arm 27 of the second lever 22, and the flange 23 of the first lever 21 is always urged onto the enlarged bottom portion 33 of the adjusting screw 31. Consequently, it will be understood that, by rotating the adjusting screw 31, the distance between the flange 23 of the first lever 21 and the arm 27 of the second lever 22 can be adjusted and, thus, the relative position, in the rotating direction, between the first lever 21 and the second lever 22 can be adjusted.

As illustrated in FIG. 4, a metering needle 35 is amounted on the arm 28 of the second lever 22. This metering needle 35 is inserted into a hole (not shown) formed in the arm 28, and a compression spring 37 is inserted between the arm 28 and a spring retainer 36 fixed onto the metering needle 35 so that an enlarged head portion 38 of the metering needle 35 is always urged onto the arm 28. In addition, as illustrated in FIG. 3, the metering needle 35 has a tapered lower end 39 which is inserted into the metering jet 15 for controlling the flow area of the metering jet 15.

When the opening degree of the primary throttle valve 3 is smaller than a predetermined opening degree, the secondary throttle valve 8 is completely closed. At this time, since the air valve 10 is completely closed, the flow area of the metering jet 15 is minimum. When the opening degree of the primary throttle valve 3 becomes greater than the predetermined opening degree, the secondary throttle valve 8 is opened. At this time, the air valve 10 is opened to an opening degree wherein the force of opening the air valve 10, which is caused by the pressure difference between the upstream side and the downstream side of the air valve 10, becomes equal to the force of closing the air valve 10, which is caused by the coil spring 19. When the air valve 10 is opened as mentioned above, since the cam 17 is rotated, both the first lever 21 and the second lever 22 are rotated in the clockwise direction in FIG. 4. As a result of this, since the metering needle 35 is caused to move upward, the flow area of the metering jet 15 is increased. As will be understood from the above description, the flow area of the metering jet 15 is controlled in accordance with a change in the opening degree of the air valve 10 and, therefore, the amount of fuel, injected from the nozzle holes 21 of the secondary main nozzle 9, is controlled in accordance with a change in the opening degree of the air valve 10. As illustrated in FIGS. 2 and 3, since the nozzle holes 12 are directed to a direction perpendicular to the flow direction of air, the liquid fuel, injected from the nozzle holes 12, is diffused and divided into fine particles. Therefore, a good vaporization of fuel can be obtained.

Figure 6:
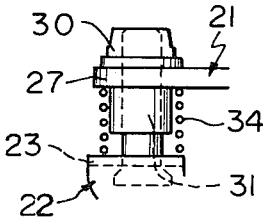
FIG. 6 is a side view of a portion of the carburetor illustrated in FIG. 4, with the enlarged head portion of an adjusting screw being removed.

As illustrated in FIG. 4, the adjusting screw 31 has on its projecting upper end an enlarged head 40, and a screw driver receiving groove 41 is formed on the top face of the enlarged head 40. In addition, a reduced diameter portion 43, having a diameter which is smaller than the minor diameter of the threaded portion 31*a* of the adjusting screw 31, is formed on the projecting portion of the adjusting screw 31, which is located between the enlarged head 41 and a top face 42 of the hollow cylindrical portion 30. As mentioned above, the relative position of the first lever 21 and the second lever 22 can be adjusted by rotating the adjusting screw 31, and the adjusting screw 31 is most suitably adjusted so as to obtain a good drivability and a good purifying efficiency of the exhaust gas when the engine is assembled in factories. After adjustment, the adjusting screw 31 is cut at the reduced diameter portion 43 thereof and, then, as illustrated in FIG. 6, the upper end of the hollow cylindrical portion 30 is slightly bent inwardly. Consequently, users cannot operate the adjusting screw 31. In addition, by bending the upper end of the hollow cylindrical portion 30 as mentioned above, the adjusting screw 31 is rigidly fixed into the hollow cylindrical portion 30.

Figure 7:
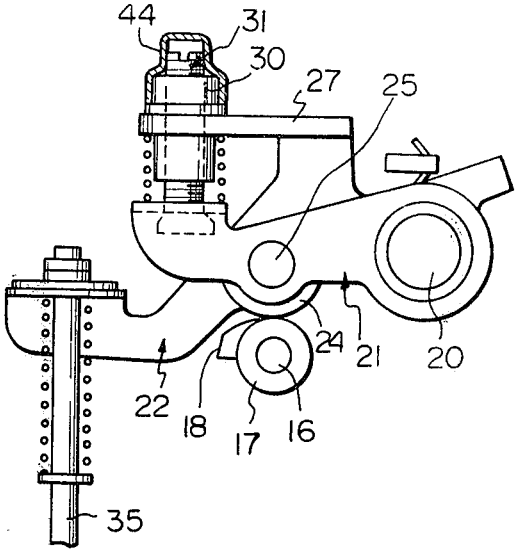
FIG. 7 is a side view of another embodiment according to the present invention.

FIG. 7 illustrates another embodiment. In this embodiment, a cap 44, made of a metallic material or a synthetic resin, is fitted onto the hollow cylindrical portion 30 so as to cover the adjusting screw 31.

Figure 8:
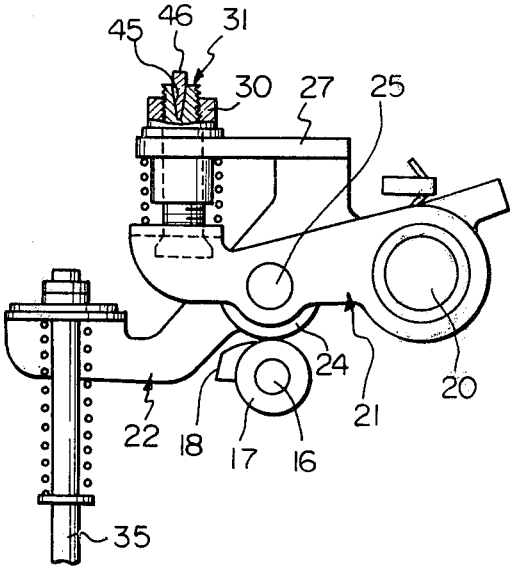
FIG. 8 is a side of a further embodiment according to the present invention.

FIG. 8 illustrates a further embodiment. In this embodiment, a V shaped cut 45 is formed on the top portion of the adjusting screw 31, and a wedge 46 is driven into the cut 45.

According to the present invention, users cannot arbitrarily operate the adjusting screw which is most suitably adjusted. Consequently, a high purifying efficiency of the exhaust gas and a good drivability can be maintained after vehicles are delivered to users.

While the invention has been described by reference to specific embodiments chosen for purposes of illustration, it should be apparent that numerous modifications could be made thereto by those skilled in the art without departing from the basic concept and scope of the invention.

We claim:

1. A carburetor comprising: a float chamber; an air horn; a fuel nozzle arranged in said air horn, a valve shaft passing through said air horn and rotatably mounted on said carburetor; a normally closed type spring loaded air valve arranged in said air horn and fixed onto said valve shaft, said air valve being automatically opened in accordance with an increase in the amount of air flowing within said air horn; a fuel passage connecting said float chamber to said fuel nozzle; a cam fixed onto said valve shaft; lever means rotatably mounted on said carburetor and engaging with said cam; and a metering needle supported by said lever means and arranged in said fuel passage for increasing the flow area of said fuel passage in accordance with an increase in the amount of said air, a roller rotatably mounted on said lever means and engaging with said cam; wherein said lever means comprises a first lever pivotally mounted on said carburetor and supporting said roller, a second lever pivotally mounted on said carburetor and supporting said metering needle, and adjusting means interconnecting said second lever to said first lever for adjusting the relative position between said first lever and said second lever, comprising a hollow cylindrical wall formed on said second lever and having a threaded hole formed therein, said hollow cylindrical wall having a thin wall and a top face, and an adjusting screw having an enlarged head portion which projects outward from the top of said hollow cylindrical wall and having a threaded portion screwed into the threaded hole of said hollow cylindrical wall, said adjusting screw interconnecting said second lever to said first lever and having a reduced diameter portion which is located between the top face of said hollow cylindrical wall and the enlarged head portion of said adjusting screw and has a diameter which is smaller than a minor diameter of the threaded portion of said adjusting screw.

2. A carburetor according to claim 1, wherein said adjusting screw has an enlarged bottom portion located at a position opposite to said enlarged head portion and engaging with said first lever, a compression spring being inserted around said adjusting screw between said first lever and said second lever.

3. A carburetor according to claim 1, wherein the enlarged head portion of said adjusting screw has a screw driver receiving groove formed thereon.

4. A carburetor as claimed in claim 1, wherein the reduced diameter portion of said adjusting screw is cut, and the hollow cylindrical wall has a top portion which is inwardly bent.

* * * * *